US006162096A

United States Patent [19]

Klaus

[11] Patent Number: 6,162,096

[45] Date of Patent: Dec. 19, 2000

[54] REFLECTOR ASSEMBLY SOCKET WHICH ACCEPTS A PL LAMP

[75] Inventor: Dale A. Klaus, St. Albans, Mo.

[73] Assignee: Dal Partnership, St. Louis, Mo.

[21] Appl. No.: 09/342,942

[22] Filed: Jun. 29, 1999

[51] Int. Cl.[7] ..... H01K 1/00

[52] U.S. Cl. ..... 439/617; 439/76.1; 439/226; 439/56

[58] Field of Search ..... 439/76.1, 56, 617, 439/682, 226, 232

[56] References Cited

U.S. PATENT DOCUMENTS

| | | | |
|---|---|---|---|
| 4,688,874 | 8/1987 | Björkman | 439/56 |
| 4,713,019 | 12/1987 | Gaynor . | |
| 5,744,901 | 4/1998 | Friederichs et al. | 439/617 |
| 5,989,067 | 11/1999 | Morgan et al. | 439/617 |
| 6,024,583 | 2/2000 | Hauselt et al. | 439/76.1 |

OTHER PUBLICATIONS

PROGRESS/ "Assembly and Installation Instructions"—Spec. No. M022542—Jan. 28, 1987.

*Primary Examiner*—Khiem Nguyen
*Attorney, Agent, or Firm*—Polster, Lieder, Woodruff & Lucchesi

[57] ABSTRACT

A ceiling mounted lighting fixture of the present invention accepts a PL-type fluorescent bulb. The lighting fixture includes a socket assembly which is recessed in a ceiling and a reflector mounted to the socket assembly. The socket assembly includes a base and a cover which cooperate to define a chamber having a bottom surface. A power supply for the PL lamp is made part of a circuit board. A receptacle on a lower surface of the bottom surface accepts the PL-bulb. The receptacle is accessible through the reflector. It includes a receptacle chamber sized and shaped to receive the bulb base, and at least two pin holes sized and shaped to receive the bulb pins. The pin holes extend through the receptacle and socket base bottom surface, so that when the bulb is inserted in the receptacle, the bulb pins will be in electrical contact with the circuit board.

8 Claims, 3 Drawing Sheets

REFLECTOR ASSEMBLY SOCKET WHICH ACCEPTS A PL LAMP

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to sockets for use with fluorescent lamps, and, in particular, to a ballasted socket for a PL-type lighting fixture which is recessed in a building's ceiling.

Prior recessed ceiling fixtures have typically used incandescent bulbs. Although incandescent bulbs are effective for lighting rooms, they produce a considerable amount of heat. Fluorescent bulbs do not produce nearly as much heat as incandescent bulbs, and use less power than incandescent bulbs. In recent years, the lighting industry introduced compact fluorescent bulbs or lamps, sometimes referred to as PL bulbs or lamps. PL lamps are much smaller than traditional tube fluorescent lamps, and can burn as brightly as incandescent bulbs. However, lighting fixtures have generally been assembled with Edison-type sockets to accept incandescent bulbs. They thus do not accept a PL lamp. Consequently, PL lamps have been sold in conjunction with a ballast and adapter to enable to lamp to be screwed into the Edison-type socket which are common in older buildings. The PL lamp, with its ballast and adapter are sold as a unit. Thus, when the PL lamp breaks, or otherwise needs to be replaced, the ballast and adapter are replaced also.

Lighting fixtures designed to accept PL lamps are becoming more common, However, only a few sockets are commercially available which accept PL lamps. Those that do are complex t o assemble and often do not include the ballast or transformer necessary for the PL lamp. Consequently, the recessed sockets for such lighting assemblies include four wires, and a four-wire connector is required in the junction box to connect the lighting fixture to the ballasting system.

BRIEF SUMMARY OF THE INVENTION

A ceiling mounted lighting fixture or reflector assembly of the present invention accepts a PL-type fluorescent bulb. As is common, the PL bulb includes a base, at least two pins extending from one side of the bulb base, and a gas tube extending from another side of the bulb base. The lighting fixture or reflector assembly includes a reflector which is recessed in a ceiling and a socket assembly which mounted to the top of the reflector. The reflector is mounted in the ceiling using a bracket assembly.

The socket assembly includes a base and a cover which cooperate to define a chamber having a bottom surface. A circuit board, which is the power supply for the PL-lamp, is housed in the chamber. Thus, a separate power supply for the fixture is not needed. The power supply is part of the socket assembly. A socket on a lower surface of the base's bottom surface accepts the PL-bulb. The socket is accessible through the reflector. It includes a socket chamber sized and shaped to receive the bulb base, and at least two pin holes sized and shaped to receive the bulb pins. The pin holes extend through the socket and socket base bottom surface, so that when the bulb is inserted in the socket, the bulb pins will be in electrical contact with the circuit board.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

A recessed ceiling light fixture or reflector assembly 1 includes a socket assembly 3, a reflector 5 which is mounted to the socket assembly 3, and a bulb 7 which is mounted in the socket assembly 3 inside of the reflector 5. The reflector assembly 1 can be mounted in the ceiling C in any conventional manner. For example, a junction box (not shown) and mounting frame can be mounted to rafters in the ceiling by bar hangers. The reflector 5, with the socket assembly 3, can be positioned in the frame.

The bulb 7 is preferably a PL-type or compact fluorescent bulb. As is known, such bulbs have a base. A gas tube extends from one side of the base, and pins extend from the opposite side of the base. As discussed below, when the bulb 7 is inserted in the socket assembly 3, the pins place the bulb in electrical communication with a ballasting system. An example of a two-pin bulb is shown in co-pending application Serial No. 148,082, filed Sep. 4, 1998, entitled Socket For A Compact Fluorescent Lamp, and which is incorporated herein by reference.

Figure 1:
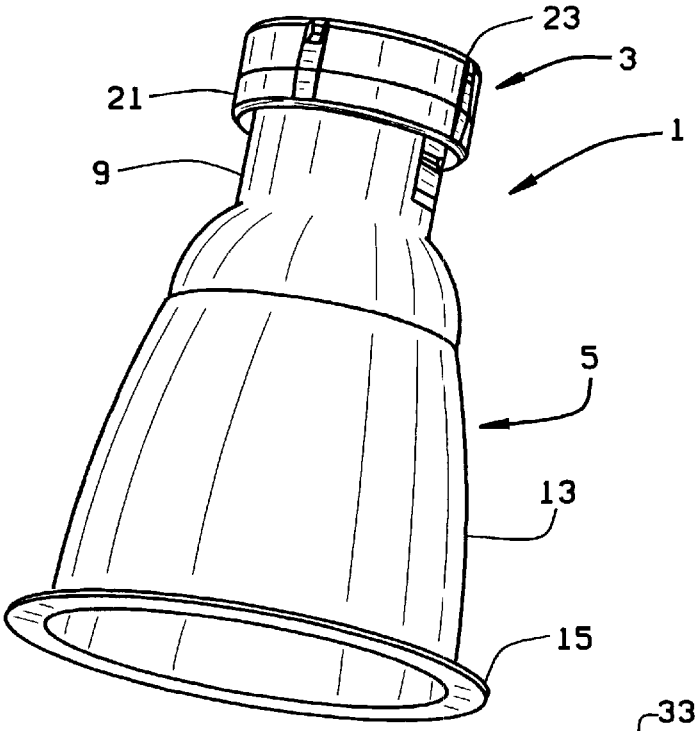
FIG. 1 is a perspective view of a recessed ceiling light fixture or reflector assembly, including a socket assembly and reflector.
Figure 2:
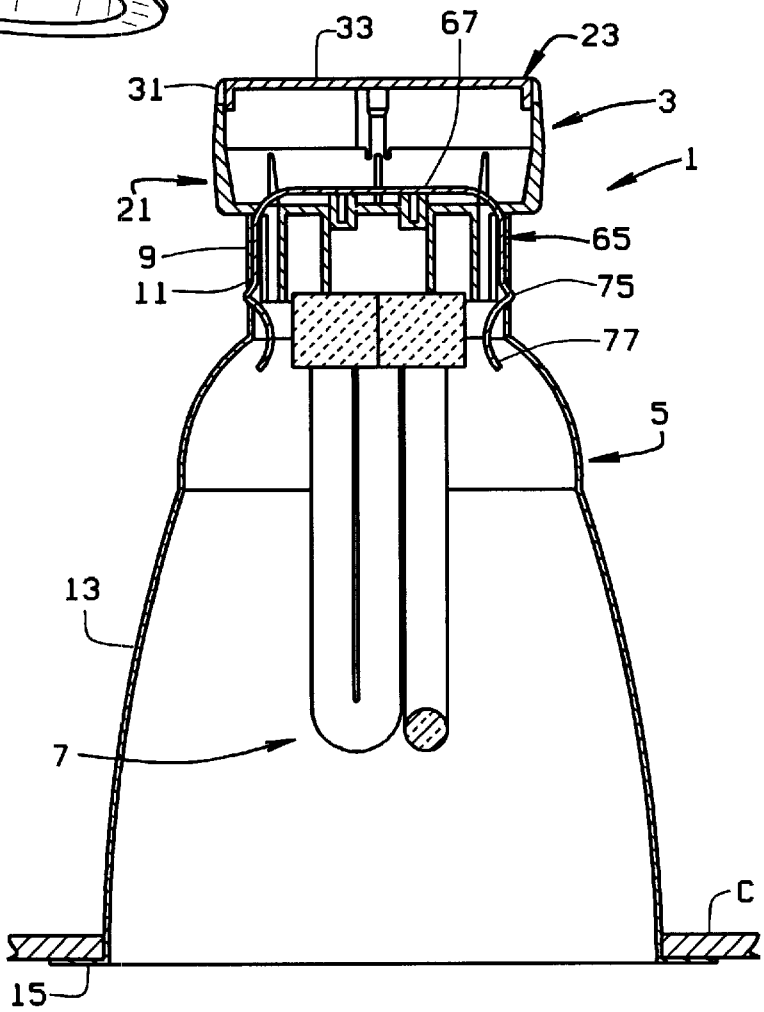
FIG. 2 is a cross-sectional view of the reflector assembly showing the socket assembly mounted on the reflector, the reflector being positioned in a ceiling.

The reflector 5 includes a generally cylindrical neck portion 9 which surrounds a portion of the socket assembly 3, as will be described below. The reflector neck 9 includes openings or slots 11. A reflector skirt 13 depends from the reflector neck 9 which surrounds the bulb 7. A lip or flange 15 extends out from the bottom of the reflector skirt 13. The light fixture 1 is recessed in a ceiling C, and the lip 15 is exposed on the underside of the ceiling C, as seen in FIG. 2.

The socket assembly 3 includes a socket base 21 and a socket cover 23. The socket base 21 and cover 23 are assembled together to define an enclosure. A circuit board 25 is housed in the socket enclosure. The circuit board, as can be appreciated, includes the circuitry and electrical components necessary for operation of the bulb 7 and light fixture 1. The circuit board thus constitutes, or operates as, the power supply for the PL lamp.

Figure 3:
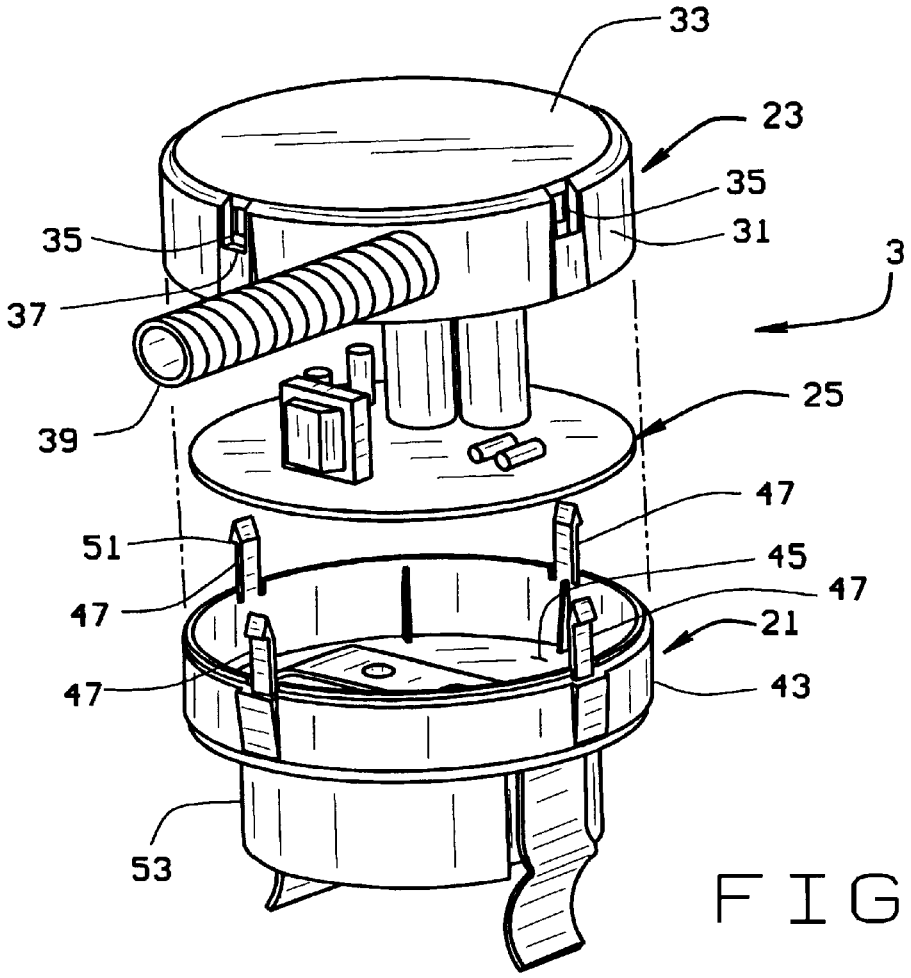
FIG. 3 is an exploded view of the socket assembly of the present invention.
Figure 4:
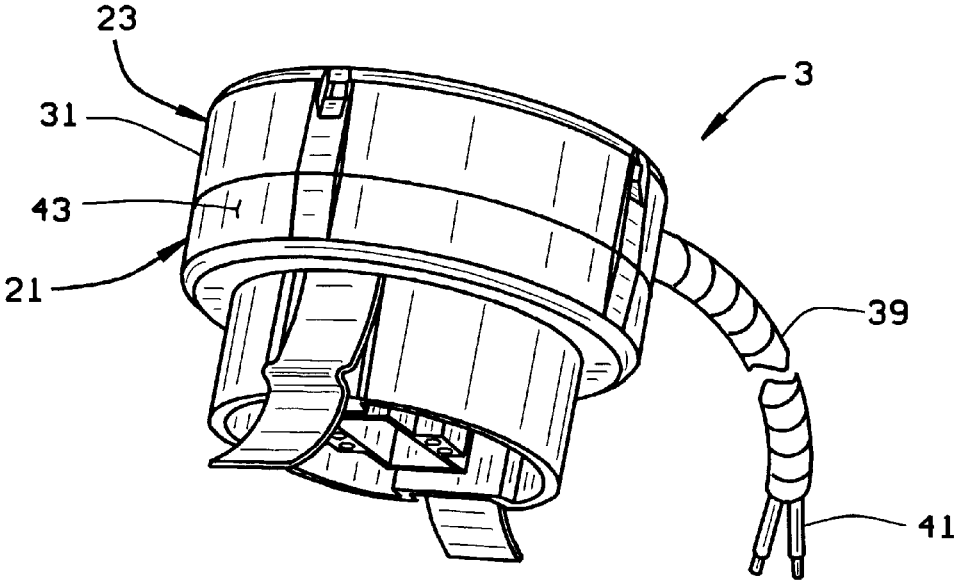
FIG. 4 is a perspective view of the socket assembly.
Figure 5:
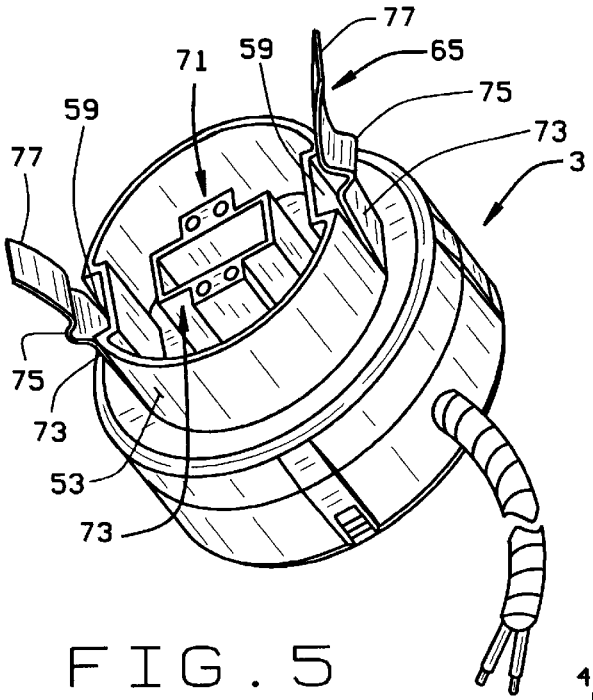
FIG. 5 is another perspective view of the socket assembly.
Figure 7:
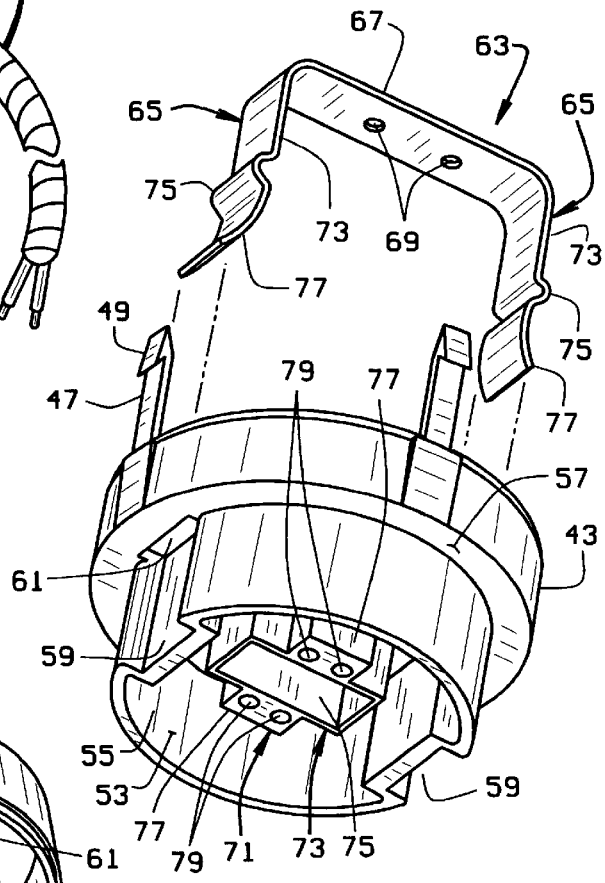
FIG. 7 is a bottom perspective view of the socket base.
Figure 6:
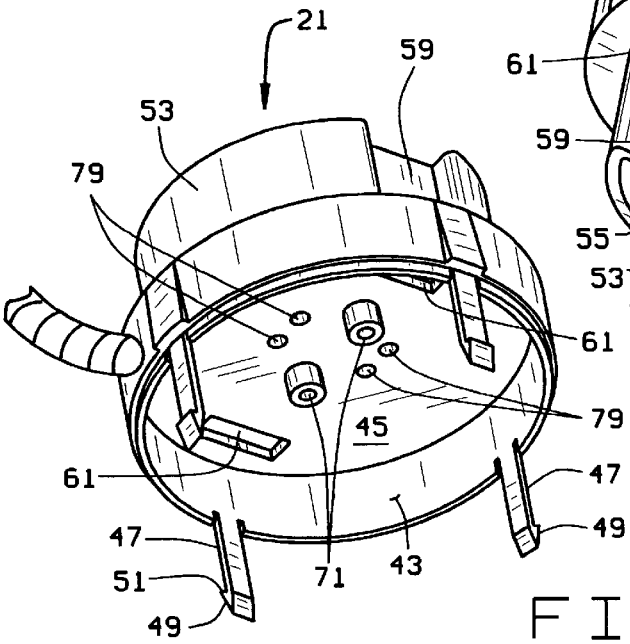
FIG. 6 is a top perspective view of a socket base of the assembly.

The socket cover 23 includes a side wall 31 and a top wall 33. The cover 23 is preferably a one-piece item which is molded out of an appropriate plastic. The edge between the side wall 31 and top wall 33 can be beveled as shown in FIGS. 3 and 4. A plurality of slots or openings 35 are formed in the side wall 31 and extend downwardly from the top of the side wall 33. Four openings are provided, of which two can be seen in FIG. 3. The openings are spaced 90° apart from each other around the cover 23. The openings 35 all have flat bottom surfaces 37. The cover 23 is adapted, as is known in the art, so that a wire conduit 39 can be connected to the cover 23. The wire conduit 39 carries wires 41 which electrically connect the light 1 to the junction box of the recessed fixture frame (not shown). The junction box then connects the socket assembly to the buildings electrical system. Two wires (a hot wire and a neutral wire) are shown. A third, ground, wire could also be included, if desired.

The socket base 21 includes a generally cylindrical wall 43 which is generally of the same diameter as the cover wall 31. A floor 45 is at the bottom of the wall 43. A plurality of flexible arms 47 extend up from the top edge of the base wall 31. The arms 47 have fingers 49 at their distal ends. The fingers 49 have flat bottom surfaces 51. To assemble the cover 23 to the base 21, the base arms 47 are aligned with the cover slots 35. The cover is then applied to the base until the arm fingers 49 engage the cover slots 35. The flat surfaces 37 and 51 of the slots and fingers, respectively, will create an interference fit which will hold the cover and base together.

A lower generally cylindrical wall 53 extends downwardly from the bottom surface 45 to define a lower chamber 55. The lower wall 53 has a diameter that is smaller than the diameter of the upper wall 43. The walls 53 and 43 thus cooperate to form a circumferential shoulder 57. A pair of opposed channels 59 are formed in the lower wall 53. Slots 61 are formed in the bottom surface 45 which are in register with the channels 59.

A bracket 63 has spring legs 65 and a base 67 extending between the legs 65. The legs 65 are spaced apart a distance so that the legs 65 can be passed through the slots 61 and received in the channels 59. A pair of screw holes 69 are formed in the bracket base 67, and screw bosses 71 extend up from the upper surface of the floor 45. The bracket 63 can thus be secured to the socket base 3 by screws (not shown) which pass through the bracket base holes 69 into the screw bosses 71 in the bracket base. The legs 65 have a generally straight portion 73, an outwardly extending projection 75 at the end of the straight portion, and an outwardly curved portion 77 extending from the projection 75. The straight portion has a length approximately equal to the height of the wall 53 so that the projection 75 will be at the bottom of the wall 53. The outer diameter of the wall 53 is slightly smaller than the inner diameter of the reflector neck 9, so that the reflector neck 9 can slide over the socket base wall 53. The bracket projections 75 and the reflector slots 11 are positioned so that when the reflector is slid over the socket base wall 53, the projections will snap into the reflector slots 11 to hold the reflector to the socket base 21, as seen in FIG. 2. The curved section 77 of the bracket legs 65 are sufficiently long so that they extend into the chamber of the reflector 5. The legs 65 can be pulled together to pull the projections 75 out of the reflector neck slots 11, allowing the reflector 5 to be removed from the socket assembly base 21 when and if necessary.

A socket or receptacle 71 extends from the underside of the floor 45 into the chamber 55. The receptacle 71, as shown, is sized and shaped to accept a four-prong PL-type bulb. The receptacle 71 includes a receptacle body 73 which is generally rectangular in plan and has a receptacle opening 75 sized to accept the base of a PL-type bulb, for example, such as a PL-T bulb sold by Philips. A projection 77 extends from either side of the receptacle body 73. The projections 77 each have two pin holes 79 which pass through the projections and floor 45, to open on the upper surface of the floor. When the bulb 7 is inserted into the receptacle 71, its pins pass through the pin holes 79 to be placed in electrical contact with the wires of the circuit board 25, the wires 41, and hence, the electrical system of the building by way of the junction box at the recessed fixture frame.

Although the socket assembly was described for use in conjunction with recessed reflector assemblies or recessed ceiling fixtures, it can also be used with ceiling fixtures which are suspended from the ceiling. In this case, the socket assembly would be recessed in the ceiling, and the reflector or lamp cover would depend from the ceiling.

As various changes could be made in the above constructions without departing from the scope of the invention, it is intended that all matter contained in the above description or shown in the accompanying drawings shall be interpreted as illustrative and not in a limiting sense. For example, other methods of mounting the reflector 5 to the socket assembly base could be used. The connection between the reflector and the socket assembly base could for example be a threaded connection. Alternatively, a pin could be provided in one of the two parts which is received in an L-shaped channel or key slot in the other of the parts. These examples are merely illustrative.

What is claimed is:

1. A ceiling mounted lighting fixture which accepts a PL-type fluorescent bulb, the PL bulb including a base, at least two pins extending from one side of the bulb base, and a gas tube extending from another side of the bulb base; the lighting fixture including a socket assembly which is recessed in a ceiling and a reflector mounted to the socket assembly;

the socket assembly comprising a base and a cover which cooperate to define a chamber having a bottom surface; an electronic power supply for the PL-lamp in the chamber; a receptacle on a lower surface of the base bottom surface; the receptacle being accessible through the reflector and adapted to removably receive the PL-type bulb, the receptacle including a receptacle chamber sized and shaped to receive the bulb base, and at least two pin holes sized and shaped to receive the bulb pins; the pin holes extending through the receptacle and socket base bottom surface and being sized, such that when the bulb is inserted in the socket, the bulb pins will be in electrical contact with the power supply.

2. The lighting fixture of claim 1 including a skirt surrounding the receptacle and a pair of spring arms, the skirt being set inwardly from an edge of the socket base bottom surface and being sized and shaped to receive the reflector; the spring arms extending from the socket base bottom surface externally of the skirt; the spring arms interacting with the reflector to mount the reflector to the socket base.

3. The lighting fixture of claim 2 wherein the skirt includes a pair of channels on an outer surface of the skirt; the spring arms extending through the channels.

4. The lighting fixture of claim 3 wherein the spring arms are part of a bracket; the spring arms being connected by a bracket base which is adjacent an upper surface of the base bottom surface; the socket assembly base including a slot in the bottom surface in register with the skirt channels; the bracket arms extending through the slots to extend through the channels.

5. A socket assembly for a ceiling mounted lighting fixture; the socket assembly accepting a PL-type fluorescent bulb; the PL bulb including a base, at least two pins extending from one side of the bulb base, and a gas tube extending from another side of the bulb base; the socket assembly comprising:

a base and a cover which cooperate to define a chamber having a bottom surface;

an electronic power supply for the PL-lamp housed in the chamber;

a receptacle on a lower surface of the chamber bottom surface, the receptacle removably receiving the PL-type bulb, the receptacle including a receptacle chamber sized and shaped to receive the bulb base, and at least two pin holes sized and shaped to receive the bulb pins; the pin holes extending through the receptacle and socket assembly bottom surface and being sized, such that when the bulb is inserted in the receptacle, the bulb pins will be in electrical contact with the power supply.

6. The socket assembly of claim 5 including a skirt surrounding the receptacle and a pair of spring arms, the skirt being set inwardly from an edge of the socket base bottom surface; the spring arms extending from the socket base bottom surface externally of the skirt.

7. The socket assembly of claim 6 wherein the skirt includes a pair of channels on an outer surface of the skirt; the spring arms extending through the channels.

8. The socket assembly of claim 7 wherein the spring arms are part of a bracket; the spring arms being connected by a bracket base; the assembly base including a slot in the bottom surface in register with the skirt channels; the bracket arms extending through the slots to extend through the channels.

* * * * *